US010061259B2

(12) United States Patent
Nagashima

(10) Patent No.: US 10,061,259 B2
(45) Date of Patent: Aug. 28, 2018

(54) IMAGE FORMING APPARATUS

(71) Applicant: KYOCERA Document Solutions Inc., Osaka-shi, Osaka (JP)

(72) Inventor: Teruhiko Nagashima, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/633,453

(22) Filed: Jun. 26, 2017

(65) Prior Publication Data

US 2017/0371293 A1 Dec. 28, 2017

(30) Foreign Application Priority Data

Jun. 27, 2016 (JP) ..... 2016-126521

(51) Int. Cl.

| | |
|---|---|
| ***G03G 21/10*** | (2006.01) |
| ***G03G 21/00*** | (2006.01) |
| ***G03G 21/12*** | (2006.01) |
| ***G03G 21/18*** | (2006.01) |

(52) U.S. Cl.

CPC ..... *G03G 21/105* (2013.01); *G03G 21/0017* (2013.01); *G03G 21/12* (2013.01); *G03G 21/1846* (2013.01); *G03G 2215/0827* (2013.01); *G03G 2221/001* (2013.01); *G03G 2221/0015* (2013.01); *G03G 2221/1884* (2013.01)

(58) Field of Classification Search

CPC ..... G03G 21/10; G03G 21/105; G03G 21/12

See application file for complete search history.

(56) References Cited

U.S. PATENT DOCUMENTS 8,983,357 B2 * 3/2015 Sakashita ..... G03G 15/0189 399/358

2008/0095559 A1 4/2008 Shimizu et al.

FOREIGN PATENT DOCUMENTS

JP 2008122925 A 5/2008

* cited by examiner

*Primary Examiner* — Carla Therrien

(74) *Attorney, Agent, or Firm* — Alleman Hall Creasman & Tuttle LLP

(57) ABSTRACT

A toner guide member includes a toner discharge port that is located above and faces a toner introduction port of a waste toner container, and the toner guide member forms, in its inside, a passage of waste toner from an end portion of a drum cleaning device to a toner discharge port. A first paddle conveyance member including a plurality of first blade portions rotates in a first rotation direction in the toner guide member. A second paddle conveyance member including a plurality of second blade portions rotates in a second rotation direction that is opposite to the first rotation direction, at a position lower than the first paddle conveyance member. A pivotal trajectory of the plurality of first blade portions partially overlaps with a pivotal trajectory of the plurality of second blade portions.

9 Claims, 11 Drawing Sheets

IMAGE FORMING APPARATUS

INCORPORATION BY REFERENCE

This application is based upon and claims the benefit of priority from the corresponding Japanese Patent Application No. 2016-126521 filed on Jun. 27, 2016, the entire contents of which are incorporated herein by reference.

BACKGROUND

The present disclosure relates to an image forming apparatus that can convey waste toner removed from a photoconductor drum, to a waste toner container.

In an electrophotographic image forming apparatus, a cleaning device removes waste toner from a photoconductor drum. In addition, a color image forming apparatus of a tandem type includes a plurality of cleaning devices that remove waste toner respectively from a plurality of photoconductor drums and an intermediate transfer belt.

The cleaning device uses, for example, conveyance screws that are disposed along the longitudinal direction of the photoconductor drums so as to convey the waste toner to one of opposite ends of the photoconductor drums that oppose to each other in the longitudinal direction.

In addition, there is known a color image forming apparatus in which a plurality of conveyance belts convey the waste toner from end portions of a plurality of cleaning devices to a plurality of waste toner containers that are disposed above the plurality of cleaning devices.

SUMMARY

An image forming apparatus according to an aspect of the present disclosure includes a photoconductor drum, a drum cleaning device, a waste toner container, a toner guide member, a first paddle conveyance member, and a second paddle conveyance member. The drum cleaning device removes drum waste toner that is toner that has remained on a surface of the photoconductor drum after a toner image was transferred from the surface of the photoconductor drum to a transferred member, and conveys the drum waste toner to an end portion thereof disposed at one of opposite ends of the photoconductor drum that oppose to each other in a longitudinal direction of the photoconductor drum. The waste toner container includes a toner introduction port that is located below the end portion of the drum cleaning device and opened upward, and the waste toner container stores the drum waste toner that enters therein through the toner introduction port. The toner guide member includes a toner discharge port that is located above and faces the toner introduction port of the waste toner container, and the toner guide member forms, in its inside, a passage of the drum waste toner from the end portion of the drum cleaning device to the toner discharge port. The first paddle conveyance member includes a first shaft portion and a plurality of first blade portions that extend out from the first shaft portion, the first paddle conveyance member being configured to convey the drum waste toner that has dropped from the end portion of the drum cleaning device, downward by rotating around the first shaft portion in a first rotation direction in the toner guide member. The second paddle conveyance member includes a second shaft portion and a plurality of second blade portions that extend out from the second shaft portion, the second paddle conveyance member being configured to further convey the drum waste toner conveyed by the first paddle conveyance member, downward toward the toner discharge port by rotating around the second shaft portion in a second rotation direction that is opposite to the first rotation direction, at a position lower than the first paddle conveyance member in the toner guide member. A pivotal trajectory of the plurality of first blade portions partially overlaps with a pivotal trajectory of the plurality of second blade portions.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

An image forming apparatus 10 according to the present embodiment is configured to form an image on a sheet by an electrophotographic system. The sheet is a sheet-like image formation medium such as a sheet of paper or an envelope.

It is noted that, for the sake of convenience, directions are defined as follows. An up-down direction D0 is defined as the vertical direction in a state where the image forming apparatus 10 is installed usably. A first lateral direction D1 is defined as the width direction of a sheet tray 1*x* to which a sheet with an image formed thereon is discharged. A second lateral direction D2 is defined as a horizontal direction perpendicular to the first lateral direction D1.

[Configuration of Image Forming Apparatus 10]

Figure 1:
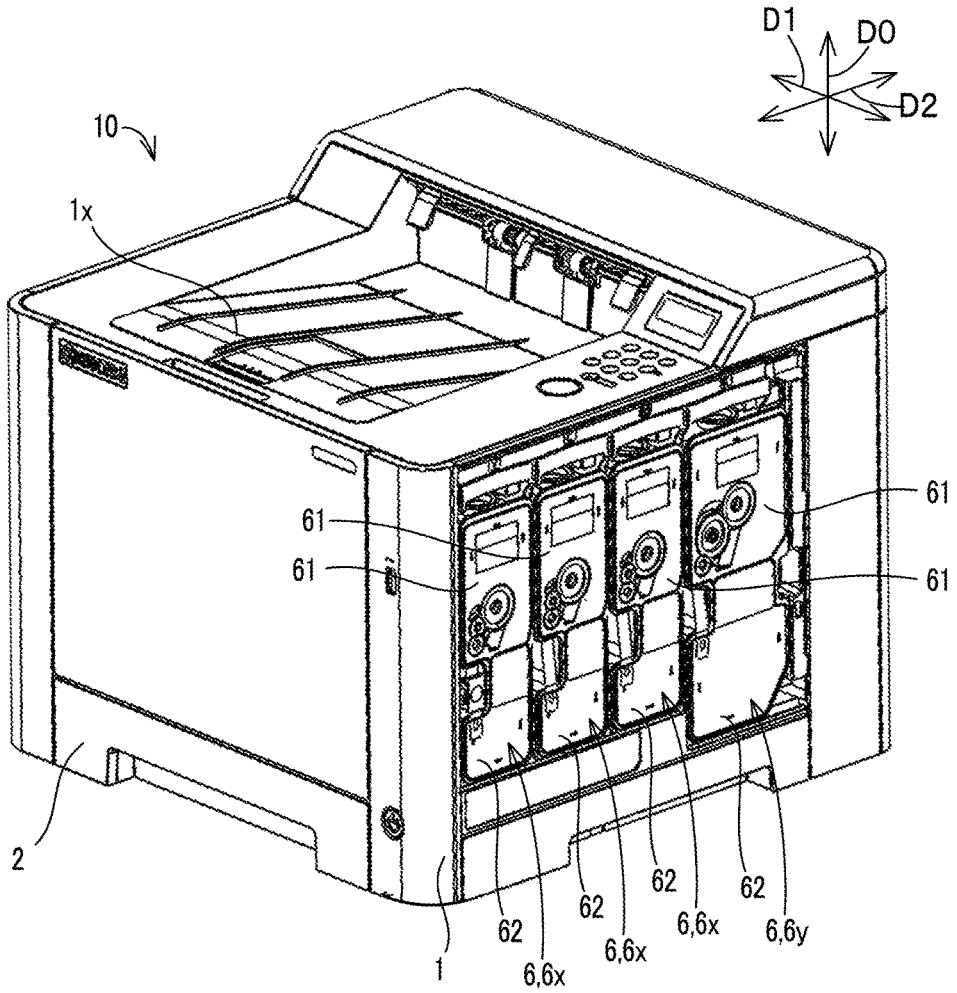
FIG. 1 is a perspective view of an image forming apparatus according to an embodiment of the present disclosure.
Figure 2:
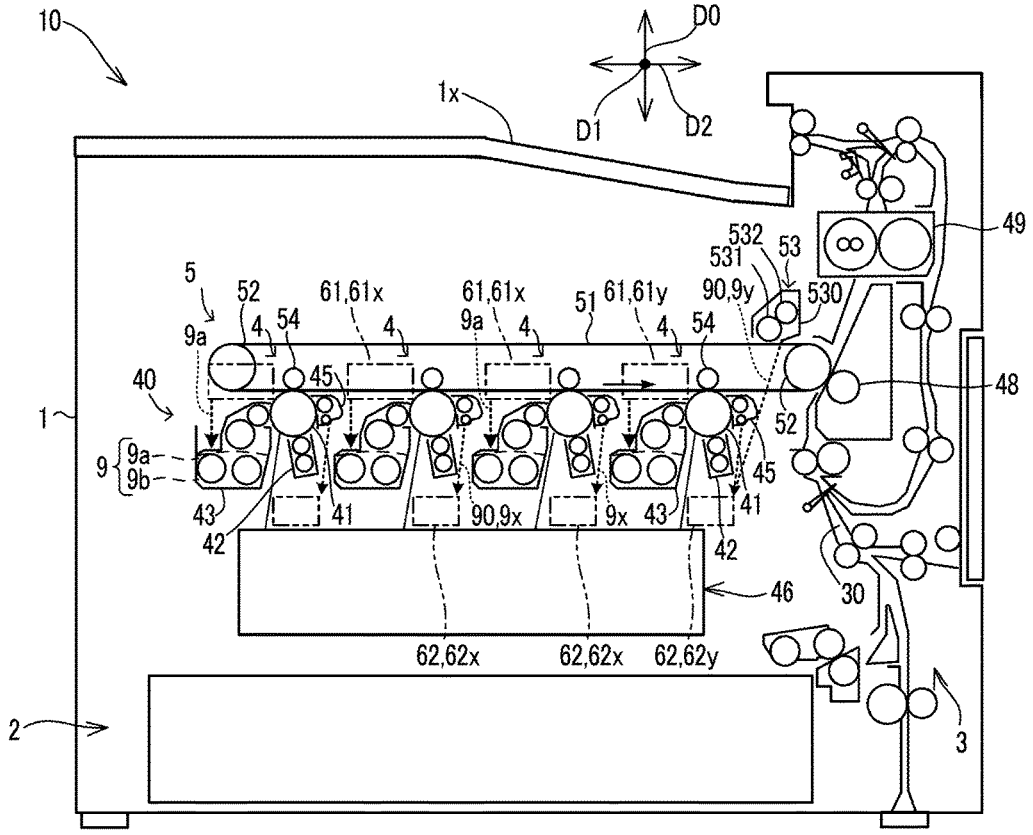
FIG. 2 is a configuration diagram of the image forming apparatus according to the embodiment.

As shown in FIG. 1 and FIG. 2, the image forming apparatus 10 includes, in a main body portion 1, a sheet supply device 2, a sheet conveying device 3, a printing device 40, a laser scanning unit 46, a fixing device 49, a replenishing toner container 61, and a waste toner container 62. FIG. 1 shows the image forming apparatus 10 in a state where a side cover of the main body portion 1 is removed.

The printing device 40 executes an image forming process of forming a toner image on the sheet. The printing device 40 executes the image forming process by using a two-component developer 9 that includes toner 9*a* and carrier 9*b*. The carrier 9*b* is a granular material having magnetism.

The printing device 40 includes an image creating device 4. The image creating device 4 includes a photoconductor 41, a charging device 42, a developing device 43, and a drum cleaning device 45. The photoconductor 41 is drum-like. It is noted that the photoconductor 41 corresponds to the photoconductor drum.

The image forming apparatus 10 shown in FIG. 1 is a color image forming apparatus of a tandem type. As a result, the printing device 40 includes an intermediate transfer unit 5 and a plurality of image creating devices 4 that respectively correspond to a plurality of colors of the toner 9*a*.

As shown in FIG. 2, the intermediate transfer unit 5 includes an intermediate transfer belt 51, a pair of belt support rollers 52, a belt cleaning device 53, and a plurality of belt transfer devices 54 that correspond to a plurality of image creating devices 4. The pair of belt support rollers 52 rotatably support the intermediate transfer belt 51.

The image forming apparatus 10 includes four image creating devices 4 and four belt transfer devices 54 both corresponding to the toner 9*a* of four colors yellow, cyan, magenta, and black. The four image creating devices 4 are arranged along a forward direction of a lower surface of the intermediate transfer belt 51. The lower surface of the intermediate transfer belt 51 contacts a plurality of photoconductors 41.

The replenishing toner container 61 stores the toner 9*a* that is supplied to the developing device 43. As described below, the replenishing toner container 61 and the waste toner container 62 are integrally formed as a toner container 6 (see FIG. 1, FIG. 6, and FIG. 7). The toner container 6 is attached to one of opposite ends of the main body portion 1 that oppose to each other in the first lateral direction D1, in a detachable manner.

The sheet supply device 2 feeds a sheet to a sheet conveyance path 30 provided in the main body portion 1, and the sheet conveying device 3 conveys the sheet along the sheet conveyance path 30.

The photoconductor 41 rotates, and the charging device 42 charges the surface of the photoconductor 41. Furthermore, the laser scanning unit 46 writes an electrostatic latent image on the surface of the photoconductor 41 by scanning the surface with a laser beam.

The developing device 43 develops the electrostatic latent image as an image of the toner 9*a* by using the developer 9. The belt transfer devices 54 then transfers the toner image from the surface of the photoconductor 41 to the intermediate transfer belt 51.

Toner images of the plurality of colors are transferred from the plurality of photoconductors 41 to the intermediate transfer belt 51 such that a color toner image is formed on the lower surface of the intermediate transfer belt 51.

The intermediate transfer belt 51 carries the toner images transferred from the plurality of photoconductors 41 to a position where the color toner image is transferred to the sheet.

It is noted that the photoconductor 41 and the intermediate transfer belt 51 are each an example of the image carrying member that carries an image of the toner 9*a*. In addition, the intermediate transfer belt 51 is an example of the transferred member to which the toner images are transferred from the surfaces of the photoconductors 41.

Figure 3:
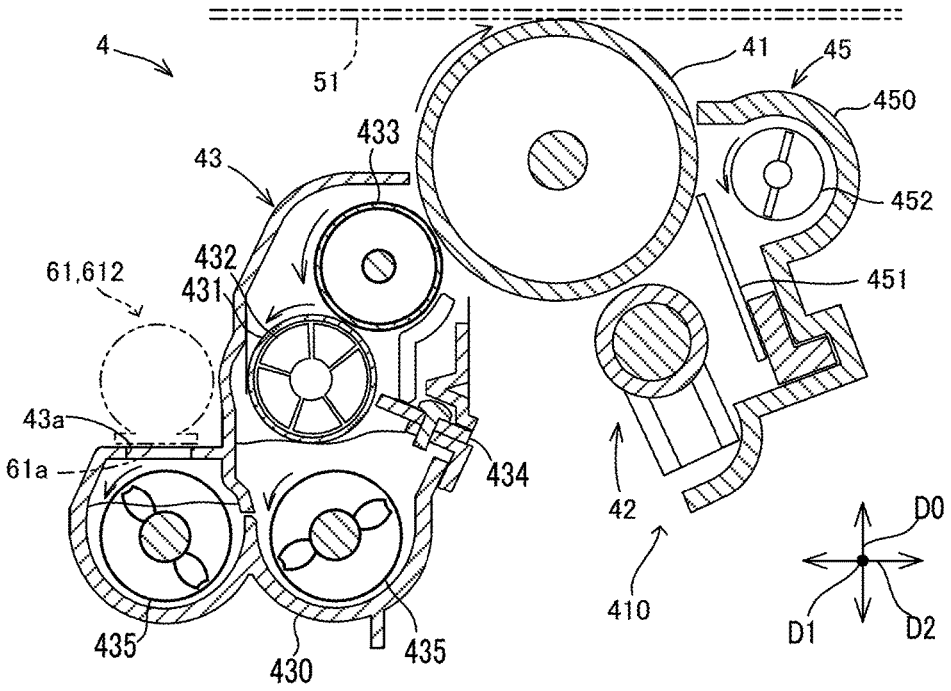
FIG. 3 is a cross-sectional view of an image forming unit included in the image forming apparatus according to the embodiment.

As shown in FIG. 3, the developing device 43 includes: a developing tank 430 storing the developer 9; a magnetic roller 431 and a stirring screw 435 that are rotated in the developing tank 430; a magnet 432 provided in the magnetic roller 431; and a blade 434.

The developing device 43 shown in FIG. 3 performs a so-called interactive touchdown developing. As a result, the developing device 43 includes a developing roller 433, as well as the magnetic roller 431.

The developing tank 430 has a toner replenishing port 43*a* that is an opening facing a replenishing toner discharge port 61*a* of the replenishing toner container 61 from below. The toner 9*a* is supplied into the developing tank 430 from the replenishing toner container 61 via the replenishing toner discharge port 61*a* and the toner replenishing port 43*a*.

The stirring screw 435 cyclically conveys, while stirring, the developer 9 in the developing tank 430. The magnetic roller 431 carries the two-component developer 9 on its circumferential surface by the magnetic force of the magnet 432 provided in its inside.

The blade 434 restricts, in thickness, the layer of the developer 9 carried by the magnetic roller 431. The magnetic roller 431 supplies the toner 9*a* among the developer 9 it carries, to the developing roller 433.

The developing roller 433 carries the toner 9*a* supplied from the magnetic roller 431, on its circumferential surface, and supplies the toner 9*a* to the electrostatic latent image on the surface of the photoconductor 41. This allows the developing roller 433 to develop the electrostatic latent image as the toner image.

A sheet transfer device 48 transfers the toner image formed on the intermediate transfer belt 51, to the sheet conveyed along the sheet conveyance path 30. The fixing device 49 fixes the toner image to the sheet by heating. The sheet that has passed through the fixing device 49 and has an image formed thereon, is discharged to the sheet tray 1*x* provided on an upper portion of the main body portion 1.

As shown in FIG. 3, the drum cleaning device 45 includes a housing 450, a cleaning blade 451, and a conveyance screw 452, wherein the cleaning blade 451 and the conveyance screw 452 are disposed in the housing 450.

The cleaning blade 451 removes toner 9*a* that has remained on the surface of the photoconductor 41 after the toner image was transferred to the intermediate transfer belt 51. Hereinafter, the toner 9*a* removed from the photoconductor 41 by the drum cleaning device 45 is referred to as drum waste toner 9*x* (see FIG. 2).

Figure 4:
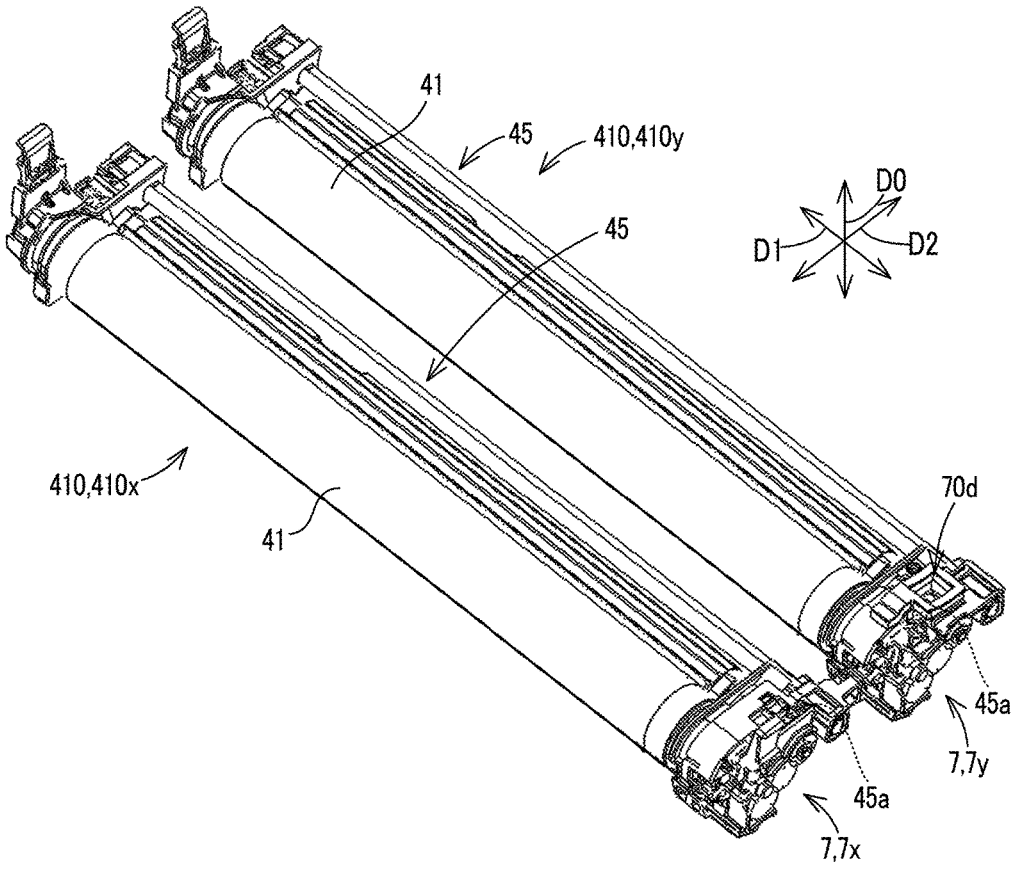
FIG. 4 is a perspective view of a drum unit included in the image forming apparatus according to the embodiment.

Furthermore, the conveyance screw 452 conveys the drum waste toner 9*x* to an end portion 45*a* that is at one of opposite ends of the drum cleaning device 45 that oppose to each other in the first lateral direction D1 (see FIG. 3, FIG. 4). One of opposite end portions of the conveyance screw 452 matches the end portion 45*a* of the drum cleaning device 45. The conveyance screw 452 includes a shaft portion and a spiral blade portion that extends out from the shaft portion.

It is noted that the first lateral direction D1 corresponds to the longitudinal direction of the photoconductor 41. In addition, the end portion 45*a* of the drum cleaning device 45 corresponds to an end portion of the main body portion 1 to which the toner container 6 is attached.

Figure 7:
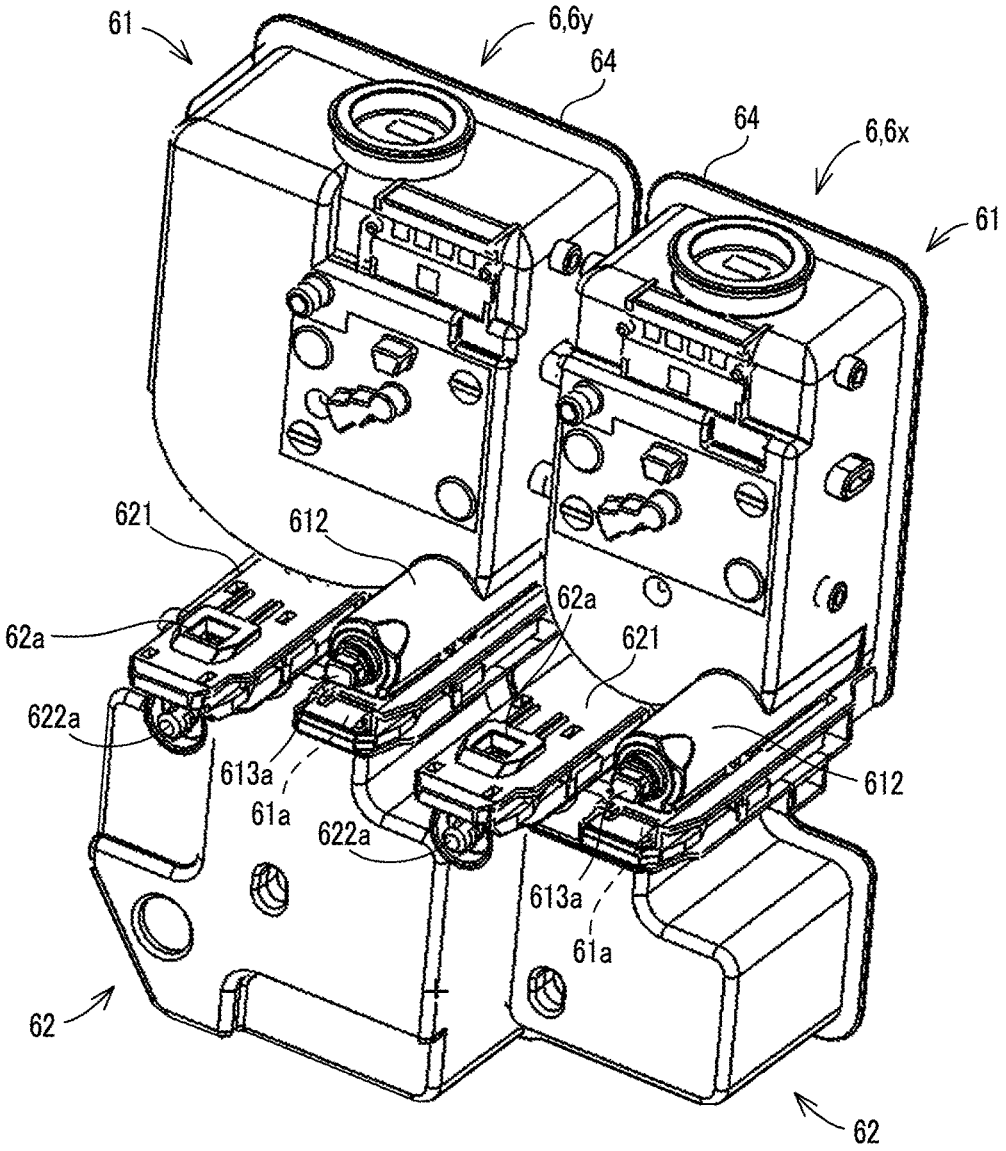
FIG. 7 is a perspective view of the toner container included in the image forming apparatus according to the embodiment.

The belt cleaning device 53 includes a housing 530, a cleaning roller 531, and a conveyance screw 532, wherein the cleaning roller 531 and the conveyance screw 532 are disposed in the housing 530 (see FIG. 2, FIG. 7). The housing 530, the cleaning roller 531, and the conveyance screw 532 are formed to extend along the first lateral direction D1.

The cleaning roller 531 rotates while contacting the surface of the intermediate transfer belt 51. With this configuration, the cleaning roller 531 removes toner 9*a* that has remained on the intermediate transfer belt 51 after the toner image was transferred therefrom to the sheet.

Hereinafter, the toner 9*a* removed from the intermediate transfer belt 51 by the belt cleaning device 53 is referred to as belt waste toner 9*y* (see FIG. 2). In addition, the drum waste toner 9*x* and the belt waste toner 9*y* are collectively referred to as waste toner 90.

Figure 10:
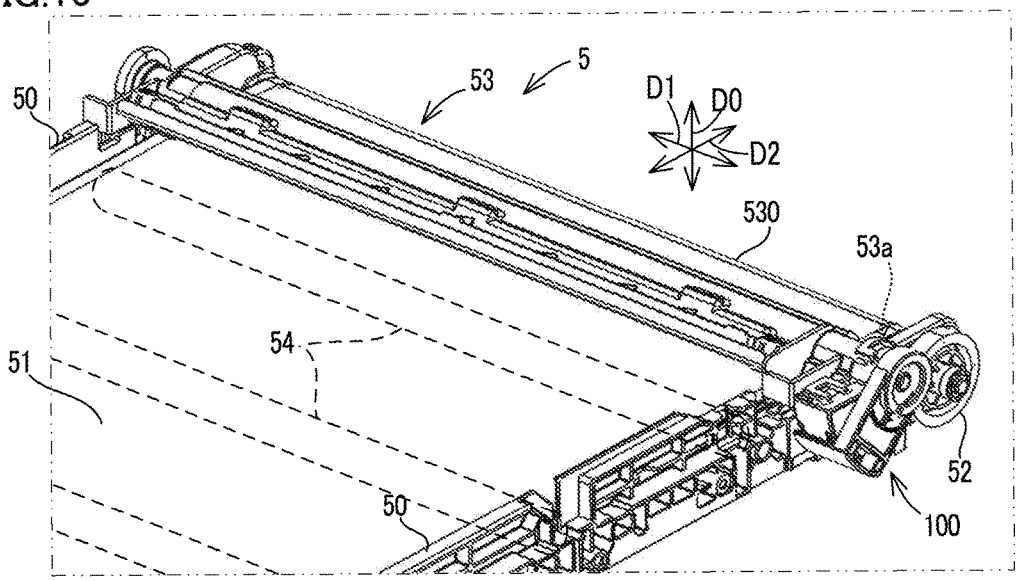
FIG. 10 is a perspective view of surroundings of a drum cleaning device in an intermediate transfer unit included in the image forming apparatus according to the embodiment.

The conveyance screw 532 of the belt cleaning device 53 conveys the belt waste toner 9*y* to an end portion 53*a* that is at one of opposite ends of the belt cleaning device 53 that oppose to each other in the first lateral direction D1 (see FIG. 10). One of end portions of the conveyance screw 452 that oppose to each other matches the end portion 53*a* of the belt cleaning device 53. The conveyance screw 532 includes a shaft portion and a spiral blade portion that extends out from the shaft portion.

It is noted that the first lateral direction D1 corresponds to the longitudinal direction of the photoconductor 41 and the longitudinal direction of the belt cleaning device 53. In addition, the end portion 45*a* of the drum cleaning device 45 and the end portion 53*a* of the belt cleaning device 53 correspond to the end portion of the main body portion 1 to which the toner container 6 is attached.

[Toner Container 6]

Figure 6:
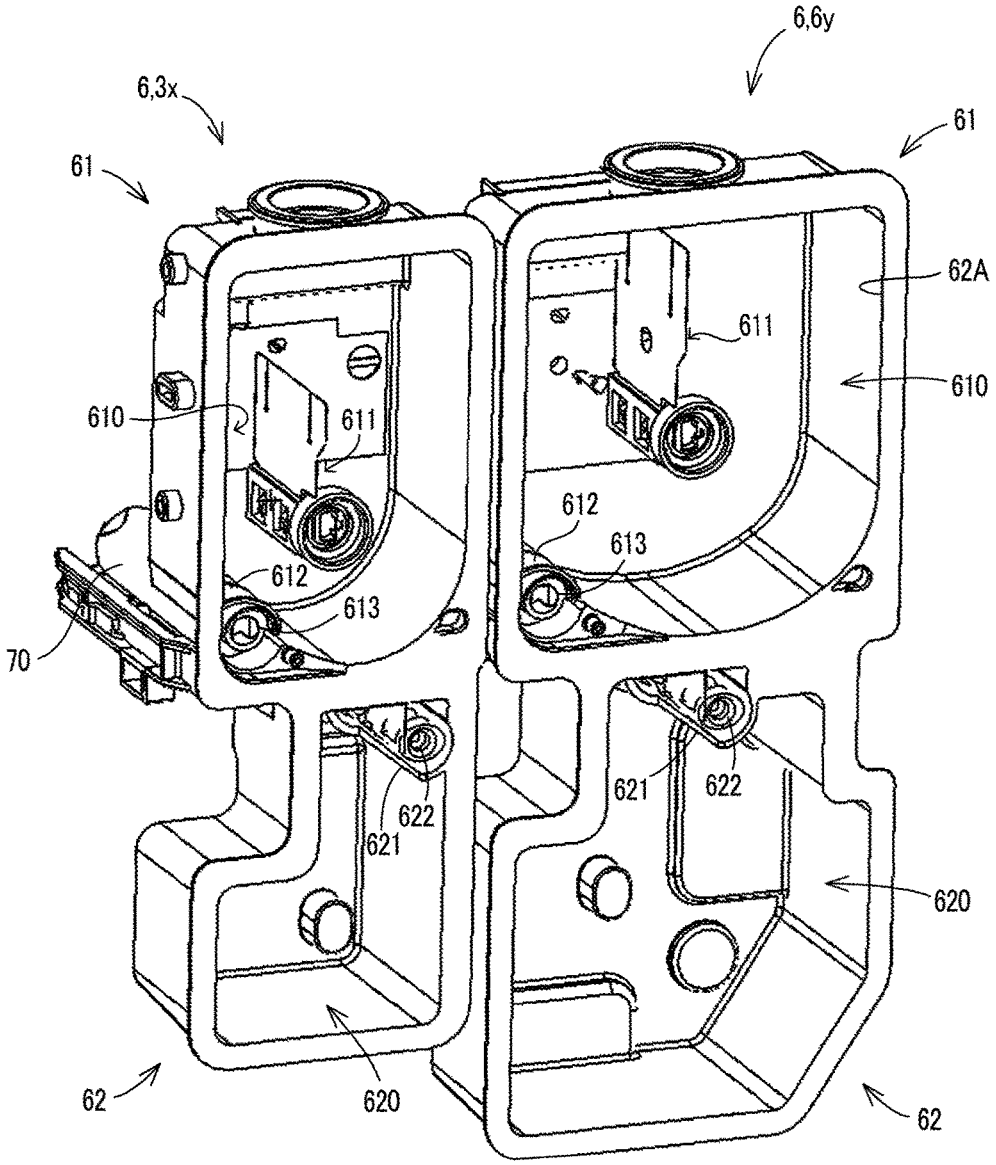
FIG. 6 is a perspective view of an inside of a toner container included in the image forming apparatus according to the embodiment.

As shown in FIG. 6 and FIG. 7, the toner container 6 includes the replenishing toner container 61 positioned on the upper side and the waste toner container 62 positioned on the lower side. A replenishing toner storage chamber 610 is formed in the replenishing toner container 61. A waste toner storage chamber 620 is formed in the waste toner container 62.

Furthermore, the replenishing toner container 61 includes a toner stirring member 611 that stirs the toner 9*a* in the replenishing toner container 61 by rotating.

The replenishing toner container 61 includes a toner replenishing duct 612 that has the replenishing toner discharge port 61*a* that is opened downward. The toner replenishing duct 612 forms a passage of the toner 9*a* that extends from the replenishing toner storage chamber 610 to the replenishing toner discharge port 61*a*.

A toner replenishing screw 613 is provided in the toner replenishing duct 612 (see FIG. 6). The toner replenishing screw 613 is a relatively short conveyance screw disposed to extend along the first lateral direction D1.

The toner replenishing screw 613 rotates as a link portion 613*a* that is provided at an end thereof, is rotationally driven, and the toner replenishing screw 613 conveys the toner 9*a* stored in the replenishing toner storage chamber 610, to the replenishing toner discharge port 61*a*.

As shown in FIG. 3, the replenishing toner discharge port 61*a* is located directly above the toner replenishing port 43*a* of the developing tank 430 and is opened downward. With this configuration, the toner 9*a* discharged from the replenishing toner discharge port 61*a* is supplied into the developing tank 430.

The waste toner container 62 includes a toner introduction duct 621 that has a toner introduction port 62*a* that is opened upward. The toner introduction duct 621 forms a passage of the drum waste toner 9*x* that extends from the toner introduction port 62*a* to the waste toner storage chamber 620.

A toner introduction screw 622 is provided in the toner introduction duct 621 (see FIG. 6). The toner introduction screw 622 is a relatively short conveyance screw disposed to extend along the first lateral direction D1.

The toner introduction screw 622 rotates as a link portion 622*a* that is provided at an end thereof, is rotationally driven, and conveys the drum waste toner 9*x* that has entered through the toner introduction port 62*a*, to the waste toner storage chamber 620.

Figure 5:
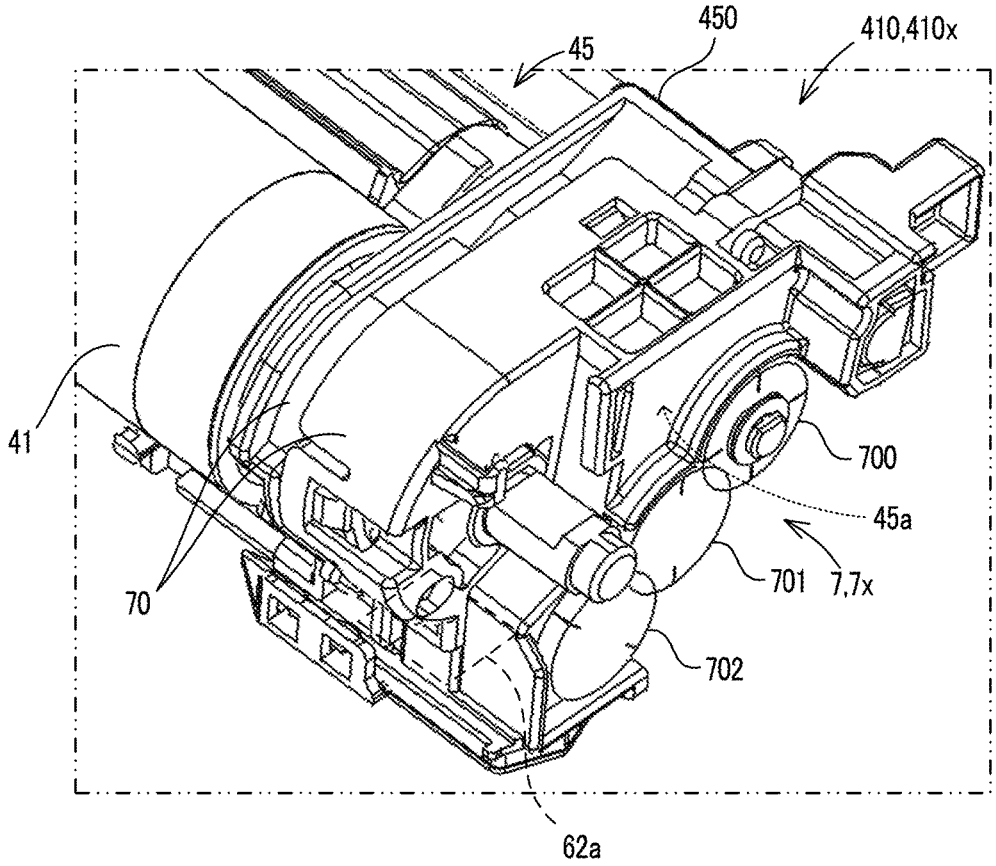
FIG. 5 is a perspective view of an end portion of a standard drum unit included in the image forming apparatus according to the embodiment.

As shown in FIG. 5, the toner introduction port 62*a* is located directly below the end portion 45*a* of the drum cleaning device 45 and is opened upward. The waste toner container 62 stores the drum waste toner 9*x* that has entered therein through the toner introduction port 62*a*.

Meanwhile, in a case where the waste toner 90 is conveyed by the conveyance belt, the hollow portion and the space for the return path of the loop conveyance belt are wasteful spaces.

In addition, although the conveyance screw can convey the waste toner 90 efficiently, it is often difficult to dispose the conveyance screw between the waste toner container 62 and the drum cleaning device 45 and the belt cleaning device 53 when the layout of the parts such as the motor and the gear in the apparatus is taken into consideration.

On the other hand, in the image forming apparatus 10, satisfying both the miniaturization of the apparatus and the efficient conveyance of the waste toner 90 from the drum cleaning device 45 and the belt cleaning device 53 to the waste toner container 62 is demanded.

The image forming apparatus 10 includes a waste toner conveyance mechanism 7 and a relay guide member 100 that are described below. With this configuration, the image forming apparatus 10 can satisfy both the miniaturization of the apparatus and the efficient conveyance of the waste toner 90 from the drum cleaning device 45 and the belt cleaning device 53 to the waste toner container 62.

[Waste Toner Conveyance Mechanism 7]

As shown in FIG. 4 and FIG. 5, the waste toner conveyance mechanism 7 is provided at an end of the photoconductor 41 and the drum cleaning device 45, the end being one of opposite ends opposing to each other in the first lateral direction D1.

The photoconductor 41, the charging device 42, the drum cleaning device 45, and the waste toner conveyance mechanism 7 are unitized as a drum unit 410. The image forming apparatus 10 is the tandem type and includes four drum units 410 that correspond to the four colors of the toner 9*a*. The intermediate transfer belt 51 is disposed above the plurality of drum units 410.

In the present embodiment, a drum unit 410 for black among the four drum units 410 is disposed on the most downstream side in the forward direction of the lower surface of the intermediate transfer belt 51, namely, disposed closest to the sheet transfer device 48. In addition, the belt cleaning device 53 is disposed to face a portion of the upper surface of the intermediate transfer belt 51 that is close to the sheet transfer device 48.

As a result, among the four drum units 410, the drum unit 410 corresponding to the black toner 9*a* is disposed closest to the belt cleaning device 53.

In the following description, for the sake of distinction, the drum unit 410 closest to the belt cleaning device 53 may be referred to as a specific drum unit 410*y*, and the other three drum units 410 may be referred to as standard drum units 410*x* (see FIG. 4, FIG. 5, FIG. 9).

In addition, the four toner containers 6 include a specific toner container 6*y* and three standard toner containers 6*x*, wherein the specific toner container 6*y* corresponds to the specific drum unit 410*y*, and the three standard toner containers 6*x* correspond to the three standard drum units 410*x* (see FIG. 1, FIG. 6, FIG. 7). That is, the image forming apparatus 10 includes a plurality of waste toner containers 62 that correspond to a plurality of drum units 410.

The three standard toner containers 6*x* and the specific toner container 6*y* have the same structure. However, the specific toner container 6*y* is larger in size than the three standard toner containers 6*x*.

Figure 9:
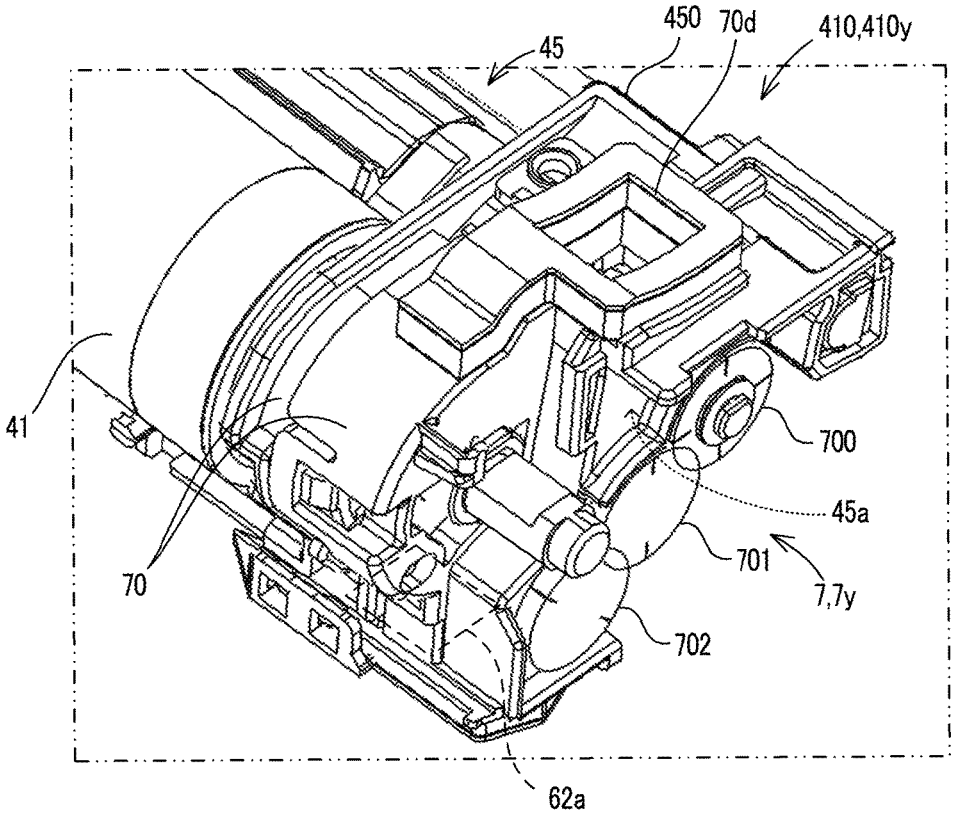
FIG. 9 is a perspective view of an end portion of a specific drum unit included in the image forming apparatus according to the embodiment.

Furthermore, the four waste toner conveyance mechanisms 7 are composed of a specific waste toner conveyance mechanism 7*y* and three standard waste toner conveyance mechanisms 7*x*, wherein the specific waste toner conveyance mechanism 7*y* constitutes a part of the specific drum unit 410*y* and the three standard waste toner conveyance mechanisms 7*x* constitute a part of the three standard drum units 410*x* (see FIG. 4, FIG. 5, FIG. 9).

The specific waste toner conveyance mechanism 7*y* has some additional components compared to the standard waste toner conveyance mechanism 7*x*. The following describes the structure and function of the waste toner conveyance mechanism 7 that are common to the standard waste toner conveyance mechanisms 7*x* and the specific waste toner conveyance mechanism 7*y*.

The waste toner conveyance mechanism 7 conveys drum waste toner 9*x* that has been conveyed by the drum cleaning device 45 to the end portion 45*a* of the drum cleaning device 45, toward the toner introduction port 62*a* of the waste toner container 62 that is located below the end portion 45*a*. In the present embodiment, the toner introduction port 62*a* of the waste toner container 62 is located diagonally below the end portion 45*a* of the drum cleaning device 45.

Figure 8:
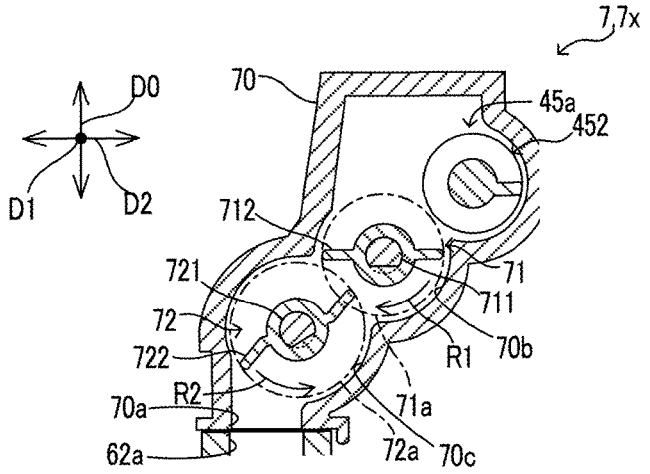
FIG. 8 is a cross-sectional view of a standard toner conveyance mechanism included in the image forming apparatus according to the embodiment.
Figure 12:
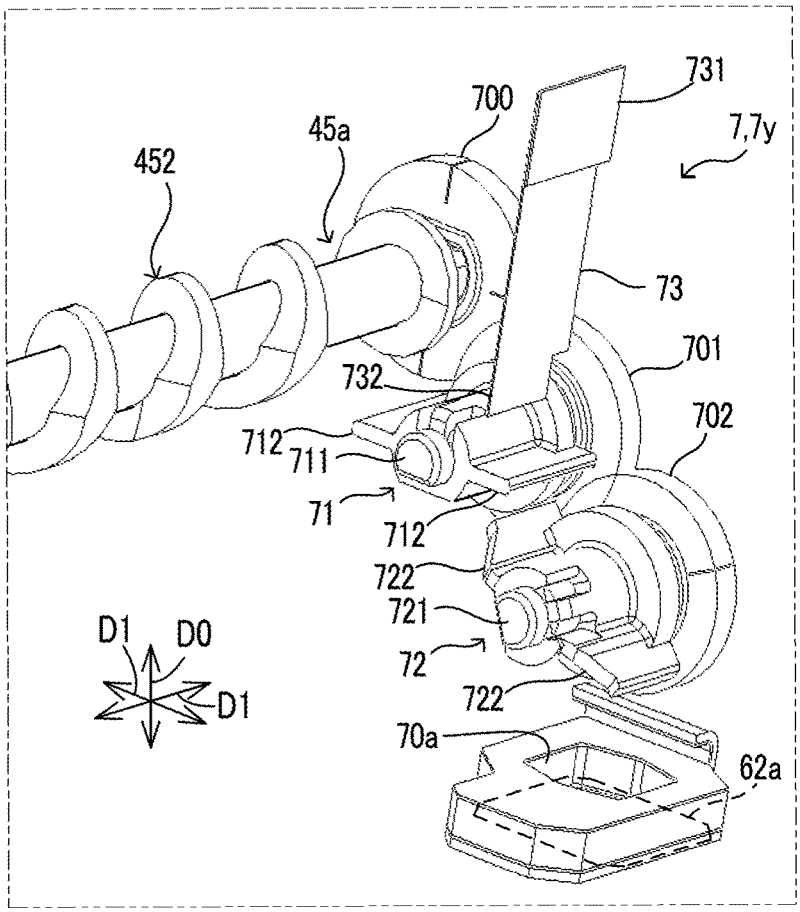
FIG. 12 is a perspective view of a specific toner conveyance mechanism in the image forming apparatus according to the embodiment.

As shown in FIG. 5, FIG. 8, and FIG. 12, the waste toner conveyance mechanism 7 includes a toner guide member 70, a first paddle conveyance member 71, and a second paddle conveyance member 72.

The toner guide member 70 is a housing including a toner discharge port 70*a* that is located above and faces the toner introduction port 62*a* of the waste toner container 62. For example, the toner guide member 70 is composed of a plurality of resin members.

The toner guide member 70 forms, in its inside, a passage of the drum waste toner 9*x* from the end portion 45*a* of the drum cleaning device 45 to the toner discharge port 70*a*.

The first paddle conveyance member 71 includes a first shaft portion 711 and a plurality of first blade portions 712 that extend out from the first shaft portion 711. In the example shown in FIG. 8 and FIG. 12, the first paddle conveyance member 71 includes two first blade portions 712 that extend out from the first shaft portion 711 in opposite directions.

The first paddle conveyance member 71 is supported so as to be rotatable in the toner guide member 70. For example, the toner guide member 70 includes a bearing portion (not shown) that supports the first shaft portion 711.

The first paddle conveyance member 71 conveys drum waste toner 9*x* that has dropped from the end portion 45*a* of the drum cleaning device 45, downward by rotating around the first shaft portion 711 in a first rotation direction R1.

The second paddle conveyance member 72 includes a second shaft portion 721 and a plurality of second blade portions 722 that extend out from the second shaft portion 721. In the example shown in FIG. 8 and FIG. 12, the second paddle conveyance member 72 includes two second blade portions 722 that extend out from the second shaft portion 721 in opposite directions.

The second paddle conveyance member 72 is rotatably supported in the toner guide member 70 at a lower position on the downstream side in a conveyance direction of the drum waste toner 9*x* with respect to the first paddle conveyance member 71. For example, the toner guide member 70 includes a bearing portion (not shown) that supports the second shaft portion 721.

In the present embodiment, the first paddle conveyance member 71 and the second paddle conveyance member 72 are arranged along a direction directed from the end portion 45*a* of the drum cleaning device 45 to the toner discharge port 70*a* that is located diagonally below the end portion 45*a* (FIG. 8). That is, the end portion 45*a* of the drum cleaning device 45 is disposed diagonally above the first paddle conveyance member 71, and the second paddle conveyance member 72 is disposed diagonally below the first paddle conveyance member 71, on an opposite side to the end portion 45*a* of the drum cleaning device 45 with the first paddle conveyance member 71 as a reference.

The second paddle conveyance member 72 further conveys the drum waste toner 9*x* conveyed by the first paddle conveyance member 71, downward toward the toner discharge port 70*a* by rotating around the second shaft portion 721 in a second rotation direction R2 that is opposite to the first rotation direction R1.

In the example shown in FIG. 5 and FIG. 12, a gear 700 provided at an end of the conveyance screw 452 of the drum cleaning device 45 meshes with a gear 701 provided at an end of the first shaft portion 711, and the gear 701 meshes with a gear 702 provided at an end of the second shaft portion 721.

The conveyance screw 452, the first paddle conveyance member 71, and the second paddle conveyance member 72 rotate in conjunction with each other by the action of the gears 700, 701, and 702. In addition, with the configuration where the two gears 701 and 702 that are directly connected with the first shaft portion 711 and the second shaft portion 721 respectively, mesh with each other, the first paddle conveyance member 71 and the second paddle conveyance member 72 rotate in opposite directions.

In addition, as shown in FIG. 8, a pivotal trajectory 71*a* of the plurality of first blade portions 712 partially overlaps with a pivotal trajectory 72*a* of the plurality of second blade portions 722. For example, the first paddle conveyance member 71 and the second paddle conveyance member 72 rotate at the same speed. With this configuration, the plurality of first blade portions 712 do not come into contact with the plurality of second blade portions 722. Of course, the plurality of first blade portions 712 and the plurality of second blade portions 722 are deviated from each other in phase in the rotation direction.

In addition, one of the first paddle conveyance member 71 and the second paddle conveyance member 72 may rotate at a speed that is a multiple of two or more integers of the speed of the other.

In the waste toner conveyance mechanism 7, with adoption of the plurality of first blade portions 712 and the plurality of second blade portions 722 that have a relatively large area, it is possible to convey the drum waste toner 9*x* from the end portion 45*a* of the drum cleaning device 45 to the toner introduction port 62*a* of the waste toner container 62 efficiently.

The first paddle conveyance member 71 and the second paddle conveyance member 72 are disposed as close to each other as their pivotal trajectory 71*a* and pivotal trajectory 72*a* overlap with each other. As a result, with adoption of the waste toner conveyance mechanism 7, both the miniaturization of the image forming apparatus 10 and the efficient conveyance of the drum waste toner 9*x* from the end portion 45*a* of the drum cleaning device 45 to the toner introduction port 62*a* of the waste toner container 62 are satisfied.

In addition, as shown in FIG. 8, the first paddle conveyance member 71 is located diagonally below the end portion 45*a* of the drum cleaning device 45.

Furthermore, the toner guide member 70 includes a first inclined curved surface 70*b* that is formed in the circumference of the first paddle conveyance member 71 in a range extending from a position close to the end portion 45*a* of the drum cleaning device 45 to another position located diagonally below the position. The first inclined curved surface 70*b* is formed along the outer edge of the pivotal trajectory 71*a* of the plurality of first blade portions 712.

The first rotation direction R1 matches a direction in which the forward ends of the plurality of first blade portions 712 pivot from the upper end side of the first inclined curved surface 70*b* to the lower end side (see FIG. 8).

With the adoption of the first rotation direction R1, the plurality of first blade portions 712 scrape off the drum waste toner 9*x* that has dropped from the end portion 45*a* of the drum cleaning device 45, downward along the first inclined curved surface 70*b*. This allows the drum waste toner 9*x* to be conveyed smoothly downward.

In addition, the toner guide member 70 further includes a second inclined curved surface 70*c* that is formed in the circumference of the second paddle conveyance member 72 in a range extending from a position close to the first inclined curved surface 70*b* to another position located diagonally below the position. The second inclined curved surface 70*c* is formed along the outer edge of the pivotal trajectory 72*a* of the plurality of second blade portions 722.

The second rotation direction R2 matches a direction in which the forward ends of the plurality of second blade portions 722 pivot from the lower end side of the second inclined curved surface 70*c* to the upper end side (see FIG. 8). The plurality of second blade portions 722 scoop the drum waste toner 9*x* conveyed from the first paddle conveyance member 71, and conveys the drum waste toner 9*x* toward the toner discharge port 70*a*.

In the example shown in FIG. 8, each of the plurality of second blade portions 722 is inclined toward the downstream in the second rotation direction R2 as it extends from the root connecting to the second shaft portion 721 to the forward end. In this way, the second paddle conveyance member 72 has a structure that hardly spill the drum waste toner 9*x* while carrying.

It is noted that when two first blade portions 712 and two second blade portions 722 are provided, the conveyance efficiency of the drum waste toner 9*x* is not impaired, and it is possible to prevent the drum waste toner 9*x* from clogging between the plurality of first blade portions 712 and between the plurality of second blade portions 722.

In addition, although not shown, one of the first paddle conveyance member 71 and the second paddle conveyance member 72 may extend out from the shaft portion by a larger size than the other. In that case, the one of the first paddle conveyance member 71 and the second paddle conveyance member 72 that has a larger extension size than the other may rotate at a slower speed than the other.

As a specific example of the above, the plurality of first blade portions 712 may extend out from the first shaft portions 711 by a larger size than the plurality of second blade portions 722 extending out from the second shaft portions 721. In that case, the second paddle conveyance member 72 may rotate at a speed that is a multiple of two or more integers of the speed of the first paddle conveyance member 71.

When one of the first paddle conveyance member 71 and the second paddle conveyance member 72 that has a more circumferential space than the other, has a larger extension size than the other, it is possible to convey the drum waste toner 9*x* from the end portion 45*a* of the drum cleaning device 45 to a farther position.

Furthermore, with the configuration where one of the first paddle conveyance member 71 and the second paddle conveyance member 72 that has a larger extension size than the other rotates at a lower speed than the other, it is possible to prevent an unbalance in conveyance amount of the drum waste toner 9*x* from being generated between the first paddle conveyance member 71 and the second paddle conveyance member 72.

[Relay Guide Member 100 and Specific Waste Toner Conveyance Mechanism 7*y*]

Next, the relay guide member 100 and the specific waste toner conveyance mechanism 7*y* are described with reference to FIG. 4 and FIG. 9 to FIG. 13.

As shown in FIG. 10, in the intermediate transfer unit 5, the intermediate transfer belt 51, the pair of belt support rollers 52, the belt cleaning device 53, and the plurality of belt transfer devices 54, together with the relay guide member 100, are supported by a frame member 50. With this configuration, the intermediate transfer belt 51, the pair of belt support rollers 52, the belt cleaning device 53, the plurality of belt transfer devices 54, and the relay guide member 100 are integrally unitized.

Figure 13:
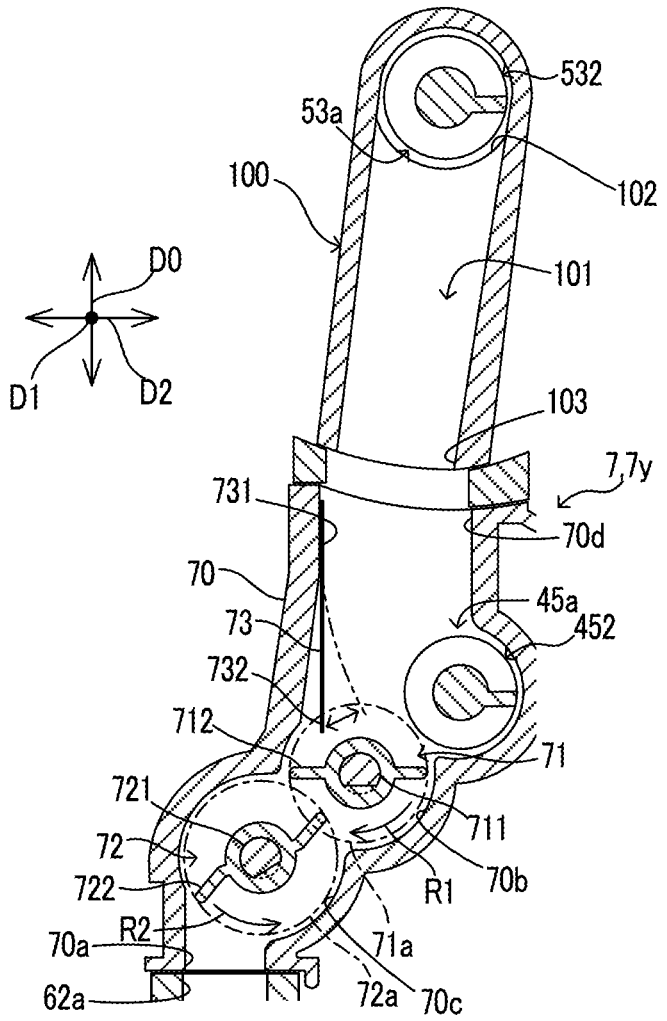
FIG. 13 is a cross-sectional view of the relay guide member and the specific toner conveyance mechanism included in the image forming apparatus according to the embodiment.

As shown in FIG. 4, FIG. 9, and FIG. 13, a relay receiving port 70*d* that is opened upward is formed in an upper portion of the toner guide member 70 of the specific waste toner conveyance mechanism 7*y*. The relay receiving port 70*d* is formed in the toner guide member 70 above the first paddle conveyance member 71.

It is noted that as shown in FIG. 4, FIG. 5, and FIG. 8, the relay receiving port 70*d* is not formed in the toner guide member 70 of each standard waste toner conveyance mechanism 7*x*.

Figure 11:
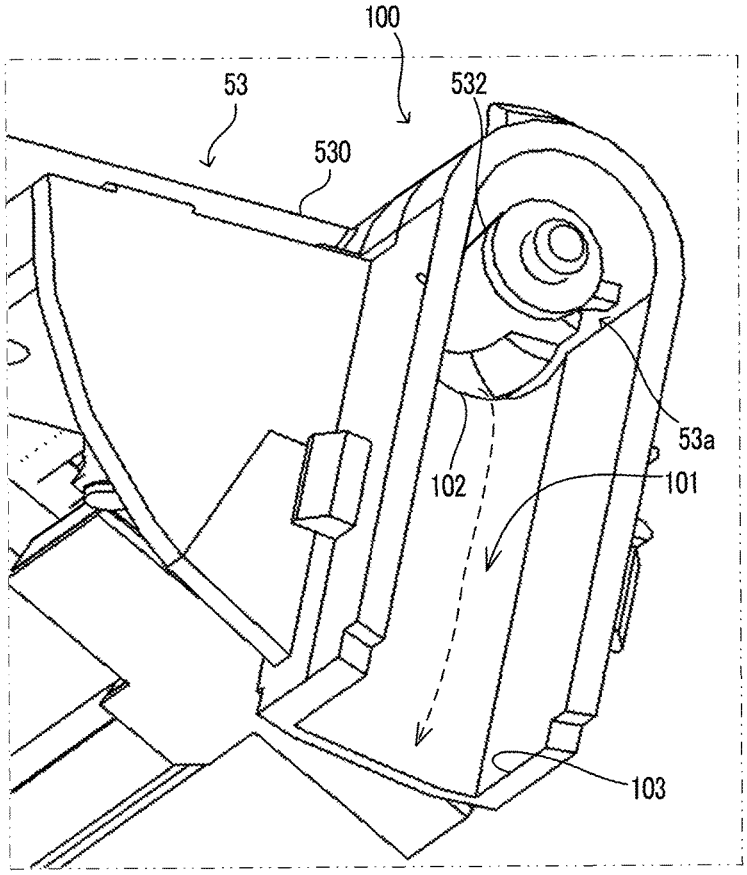
FIG. 11 is a perspective view of an inside of a relay guide member included in the image forming apparatus according to the embodiment.

Furthermore, as shown in FIG. 11, a through hole 102 is formed in the relay guide member 100, wherein an end portion of the conveyance screw 532 of the belt cleaning device 53 penetrates the through hole 102.

The relay guide member 100 includes a relay discharge port 103 that is an opening that is located above and faces the relay receiving port 70*d*. The relay guide member 100 is a duct that forms a passage 101 of the belt waste toner 9*y*, the passage 101 extending from the end portion 53*a* of the belt cleaning device 53 to the relay discharge port 103.

The belt waste toner 9*y* is conveyed to the end portion 53*a* of the belt cleaning device 53, then passes the passage 101 in the relay guide member 100, the relay discharge port 103, and the relay receiving port 70*d*, and then drops on the first paddle conveyance member 71 of the specific waste toner conveyance mechanism 7*y*.

As described above, the first paddle conveyance member 71 and the second paddle conveyance member 72 of the specific drum unit 410*y* convey the drum waste toner 9*x* and the belt waste toner 9*y*. Furthermore, the waste toner container 62 of the specific toner container 6*y* stores the drum waste toner 9*x* and the belt waste toner 9*y*. It is noted that the waste toner container 62 of the specific toner container 6*y* corresponds to the specific drum unit 410*y*.

According to the present embodiment, a conveyance mechanism and a container that are dedicated to the belt waste toner 9*y* are not necessary. Accordingly, the mechanism for conveying the waste toner 90 can have a simple structure.

In addition, as shown in FIG. 12 and FIG. 13, the specific waste toner conveyance mechanism 7*y* further includes a flexible member 73 to which a first end portion 731 is fixed, in the toner guide member 70 of the specific drum unit 410*y*. For example, the flexible member 73 is formed from a film member whose main component is PET (polyethylene terephthalate).

A second end portion 732 disposed opposite to the first end portion 731 fixed to the flexible member 73 is a free end. The second end portion 732 contacts the plurality of first blade portions 712 of the first paddle conveyance member 71 as the first blade portions 712 rotate.

The flexible member 73 swings in a space between the relay receiving port 70*d* and the first paddle conveyance member 71, according to the rotation of the first paddle conveyance member 71. Thus, a dedicated driving mechanism for swinging the flexible member 73 is not necessary.

In a case where a movable member is not present between the end portion 53*a* of the belt cleaning device 53 and the first paddle conveyance member 71, there is a possibility that, in an upper portion of the first paddle conveyance member 71, the belt waste toner 9*y* adheres to the inner surface of the toner guide member 70 and accumulates thereon.

The flexible member 73 prevents the belt waste toner 9*y* from accumulating on the inner surface of the toner guide member 70 in a state of adhering thereto. Even in a case where the belt waste toner 9*y* has accumulated thereon, the flexible member 73 contacts a lower portion of a block of the belt waste toner 9*y*, and the accumulated belt waste toner 9*y* crumbles down. With this configuration, it is possible to prevent the passage of the belt waste toner 9*y* from being closed.

Application Examples

The standard waste toner conveyance mechanism 7*x* of the image forming apparatus 10 described above may be applied to a monochrome image forming apparatus that does not include the intermediate transfer belt 51 and the belt cleaning device 53.

The waste toner conveyance mechanism 7 may include a third paddle conveyance member disposed below the second paddle conveyance member 72. In that case, the third paddle conveyance member rotates in an opposite direction to the second paddle conveyance member 72, and a pivotal trajectory of a blade portion of the third paddle conveyance member partially overlaps with that of the second paddle conveyance member 72. In addition, the waste toner conveyance mechanism 7 may include one or more paddle conveyance members on the downstream side of the third paddle conveyance member.

Furthermore, in the image forming apparatus 10, the replenishing toner container 61 and the waste toner container 62 may be provided as separate entities.

It is noted that the image forming apparatus of the present disclosure may be configured by freely combining, within the scope of claims, the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a photoconductor drum;

a drum cleaning device configured to remove drum waste toner that is toner that has remained on a surface of the photoconductor drum after a toner image was transferred from the surface of the photoconductor drum to a transferred member, and convey the drum waste toner to an end portion thereof disposed at one of opposite ends of the photoconductor drum that oppose to each other in a longitudinal direction of the photoconductor drum;

a waste toner container including a toner introduction port that is located below the end portion of the drum cleaning device and opened upward, the waste toner container being configured to store the drum waste toner that enters therein through the toner introduction port;

a toner guide member including a toner discharge port that is located above and faces the toner introduction port of the waste toner container, and forming, in its inside, a passage of the drum waste toner from the end portion of the drum cleaning device to the toner discharge port;

a first paddle conveyance member including a first shaft portion and a plurality of first blade portions that extend out from the first shaft portion, and configured to convey the drum waste toner that has dropped from the end portion of the drum cleaning device, downward by rotating around the first shaft portion in a first rotation direction in the toner guide member; and a second paddle conveyance member including a second shaft portion and a plurality of second blade portions that extend out from the second shaft portion, and configured to further convey the drum waste toner conveyed by the first paddle conveyance member, downward toward the toner discharge port by rotating around the second shaft portion in a second rotation direction that is opposite to the first rotation direction, at a position lower than the first paddle conveyance member in the toner guide member, wherein a pivotal trajectory of the plurality of first blade portions partially overlaps with a pivotal trajectory of the plurality of second blade portions, the first paddle conveyance member is located diagonally below the end portion of the drum cleaning device, the toner guide member includes an inclined curved surface that is formed in a circumference of the first paddle conveyance member in a range extending from a position close to the end portion of the drum cleaning device to another position located diagonally below the position, the inclined curved surface being formed along an outer edge of the pivotal trajectory of the plurality of first blade portions, and the first rotation direction matches a direction in which forward ends of the plurality of first blade portions pivot from an upper end side of the inclined curved surface to a lower end side thereof.

2. The image forming apparatus according to claim 1, wherein the first paddle conveyance member includes two first blade portions, and the second paddle conveyance member includes two second blade portions.

3. The image forming apparatus according to claim 1, wherein the first paddle conveyance member and the second paddle conveyance member rotate at a same speed.

4. The image forming apparatus according to claim 1, wherein the second paddle conveyance member is disposed diagonally below the first paddle conveyance member.

5. The image forming apparatus according to claim 4, wherein the end portion of the drum cleaning device is disposed diagonally above the first paddle conveyance member, and the second paddle conveyance member is disposed diagonally below the first paddle conveyance member on an opposite side to the end portion of the drum cleaning device with the first paddle conveyance member as a reference.

6. The image forming apparatus according to claim 1, further comprising:

a plurality of drum units each of which includes the photoconductor drum, the drum cleaning device, the toner guide member, the first paddle conveyance member, and the second paddle conveyance member; and a plurality of the waste toner containers respectively corresponding to the plurality of drum units, the image forming apparatus further comprising:

an intermediate transfer belt that is the transferred member disposed above the plurality of drum units and configured to carry toner images transferred thereto from the photoconductor drums of the plurality of drum units, to a position where the toner images are transferred to a sheet;

a belt cleaning device configured to remove belt waste toner that is toner that has remained on the intermediate transfer belt after the toner images were transferred therefrom to the sheet, and convey the belt waste toner to an end portion thereof disposed at the one of opposite ends of the photoconductor drums that oppose to each other in the longitudinal direction of the photoconductor drums; and a relay guide member including a relay discharge port that is located above and faces a relay receiving port formed in an upper portion of a toner guide member of a specific drum unit that is, among the plurality of drum units, closest to the belt cleaning device, the relay guide member forming a passage of the belt waste toner, the passage extending from the end portion of the belt cleaning device to the relay discharge port, wherein a first paddle conveyance member and a second paddle conveyance member of the specific drum unit convey the drum waste toner and the belt waste toner, and a waste toner container corresponding to the specific drum unit stores the drum waste toner and the belt waste toner.

7. An image forming apparatus comprising:

a photoconductor drum;

a drum cleaning device configured to remove drum waste toner that is toner that has remained on a surface of the photoconductor drum after a toner image was transferred from the surface of the photoconductor drum to a transferred member, and convey the drum waste toner to an end portion thereof disposed at one of opposite ends of the photoconductor drum that oppose to each other in a longitudinal direction of the photoconductor drum;

a waste toner container including a toner introduction port that is located below the end portion of the drum cleaning device and opened upward, the waste toner container being configured to store the drum waste toner that enters therein through the toner introduction port;

a toner guide member including a toner discharge port that is located above and faces the toner introduction port of the waste toner container, and forming, in its inside, a passage of the drum waste toner from the end portion of the drum cleaning device to the toner discharge port;

a first paddle conveyance member including a first shaft portion and a plurality of first blade portions that extend out from the first shaft portion, and configured to convey the drum waste toner that has dropped from the end portion of the drum cleaning device, downward by rotating around the first shaft portion in a first rotation direction in the toner guide member; and a second paddle conveyance member including a second shaft portion and a plurality of second blade portions that extend out from the second shaft portion, and configured to further convey the drum waste toner conveyed by the first paddle conveyance member, downward toward the toner discharge port by rotating around the second shaft portion in a second rotation direction that is opposite to the first rotation direction, at a position lower than the first paddle conveyance member in the toner guide member, wherein a pivotal trajectory of the plurality of first blade portions partially overlaps with a pivotal trajectory of the plurality of second blade portions, and one of the first paddle conveyance member and the second paddle conveyance member rotates at a speed that is a multiple of two or more integers of a speed of the other.

8. The image forming apparatus according to claim 7, wherein one of an extension size by which the plurality of first blade portions extend out from the first shaft portion and an extension size by which the plurality of second blade portions extend out from the second shaft portion is larger than the other, and one of the first paddle conveyance member and the second paddle conveyance member that has a larger extension size than the other rotates at a slower speed than the other.

9. An image forming apparatus comprising:

a photoconductor drum;

a drum cleaning device configured to remove drum waste toner that is toner that has remained on a surface of the photoconductor drum after a toner image was transferred from the surface of the photoconductor drum to a transferred member, and convey the drum waste toner to an end portion thereof disposed at one of opposite ends of the photoconductor drum that oppose to each other in a longitudinal direction of the photoconductor drum;

a waste toner container including a toner introduction port that is located below the end portion of the drum cleaning device and opened upward, the waste toner container being configured to store the drum waste toner that enters therein through the toner introduction port;

a toner guide member including a toner discharge port that is located above and faces the toner introduction port of the waste toner container, and forming, in its inside, a passage of the drum waste toner from the end portion of the drum cleaning device to the toner discharge port;

a first paddle conveyance member including a first shaft portion and a plurality of first blade portions that extend out from the first shaft portion, and configured to convey the drum waste toner that has dropped from the end portion of the drum cleaning device, downward by rotating around the first shaft portion in a first rotation direction in the toner guide member; and a second paddle conveyance member including a second shaft portion and a plurality of second blade portions that extend out from the second shaft portion, and configured to further convey the drum waste toner conveyed by the first paddle conveyance member, downward toward the toner discharge port by rotating around the second shaft portion in a second rotation direction that is opposite to the first rotation direction, at a position lower than the first paddle conveyance member in the toner guide member, a pivotal trajectory of the plurality of first blade portions partially overlapping with a pivotal trajectory of the plurality of second blade portions;

a plurality of drum units each of which includes the photoconductor drum, the drum cleaning device, the toner guide member, the first paddle conveyance member, and the second paddle conveyance member;

a plurality of the waste toner containers respectively corresponding to the plurality of drum units;

an intermediate transfer belt that is the transferred member disposed above the plurality of drum units and configured to carry toner images transferred thereto from the photoconductor drums of the plurality of drum units, to a position where the toner images are transferred to a sheet;

a belt cleaning device configured to remove belt waste toner that is toner that has remained on the intermediate transfer belt after the toner images were transferred therefrom to the sheet, and convey the belt waste toner to an end portion thereof disposed at the one of opposite ends of the photoconductor drums that oppose to each other in the longitudinal direction of the photoconductor drums; and a relay guide member including a relay discharge port that is located above and faces a relay receiving port formed in an upper portion of a toner guide member of a specific drum unit that is, among the plurality of drum units, closest to the belt cleaning device, the relay guide member forming a passage of the belt waste toner, the passage extending from the end portion of the belt cleaning device to the relay discharge port;

a first paddle conveyance member and a second paddle conveyance member of the specific drum unit that convey the drum waste toner and the belt waste toner;

a waste toner container corresponding to the specific drum unit that stores the drum waste toner and the belt waste toner; and a flexible member whose one end portion is fixed in a toner guide member of the specific drum unit, and whose free end portion disposed opposite to the end portion contacts the first paddle conveyance member, the flexible member swinging in a space between the relay receiving port and the first paddle conveyance member, according to a rotation of the first paddle conveyance member, wherein the first paddle conveyance member is located diagonally below the end portion of the drum cleaning device, the toner guide member includes an inclined curved surface that is formed in a circumference of the first paddle conveyance member in a range extending from a position close to the end portion of the drum cleaning device to another position located diagonally below the position, the inclined curved surface being formed along an outer edge of the pivotal trajectory of the plurality of first blade portions, and the first rotation direction matches a direction in which forward ends of the plurality of first blade portions pivot from an upper end side of the inclined curved surface to a lower end side thereof.

* * * * *